US005246251A

United States Patent [19]

Evans

[11] Patent Number: 5,246,251

[45] Date of Patent: Sep. 21, 1993

[54] BOOK HOLDER

[76] Inventor: Ronnie Evans, 3131 Gertrude, Dearborn, Mich. 48124

[21] Appl. No.: 931,694

[22] Filed: Aug. 18, 1992

Related U.S. Application Data

[63] Continuation-in-part of Ser. No. 720,257, Jun. 24, 1991, Pat. No. 5,165,723.

[51] Int. Cl.[5] ..... B42D 9/00

[52] U.S. Cl. ..... 281/42; 281/45

[58] Field of Search ..... 281/42, 45; 116/234; 40/352

[56] References Cited

U.S. PATENT DOCUMENTS

| | | | |
|---|---|---|---|
| 400,628 | 4/1889 | Ash | 281/42 X |
| 1,196,715 | 8/1916 | Noll . | |
| 1,710,949 | 4/1929 | Pokora . | |
| 3,140,883 | 7/1964 | Anthony | 281/42 X |
| 4,382,617 | 5/1983 | Fortier . | |
| 4,474,383 | 10/1984 | Kikis . | |
| 4,512,542 | 4/1985 | Black . | |
| 4,645,236 | 2/1987 | Kemp, Jr. . | |
| 4,932,680 | 6/1990 | Rivera . | |

FOREIGN PATENT DOCUMENTS

| | | | |
|---|---|---|---|
| 10512 | of 1888 | United Kingdom | 281/42 |
| 6537 | of 1895 | United Kingdom | 281/42 |

*Primary Examiner*—Mark Rosenbaum
*Assistant Examiner*—Willmon Fridie, Jr.
*Attorney, Agent, or Firm*—Peter D. Keefe

[57] ABSTRACT

A book holder in the form of an elongate panel composed of a light, durable material, such as plastic, including a base portion and a U-shaped end at each of the opposite sides thereof. The U-shaped ends are dimensioned so as to provide an overhang for trapping the pages of a book between the overhang and the respective adjacent base portion. In a variation of the foregoing, an extensible book holder is disclosed in which the base portion now has a right base component and a left base component which are joined so as to permit a selectively extensible interaction therebetween for accommodating books of various widths with a single book holder. In operation, the user engages an open book with the book holder so that a portion of opposing sides of the book (that is, the left and right side of the book located at opposite sides of its spine) are captured by the U-shaped ends and the base portion. The U-shaped ends are dimensioned so that they do not pose a problem with comfortable reading of the pages; indeed the plastic may be clear or otherwise see-through. When it is time to turn pages, a simple finger movement is all that is necessary to remove the page being turned from the overhang on the right and to trap it under the overhang on the left (and vice versa). Paralyzed persons and persons with arthritis or other disabilities can easily turn book pages using the book holder, needing only a pencil-like tool held in their mouth.

6 Claims, 2 Drawing Sheets

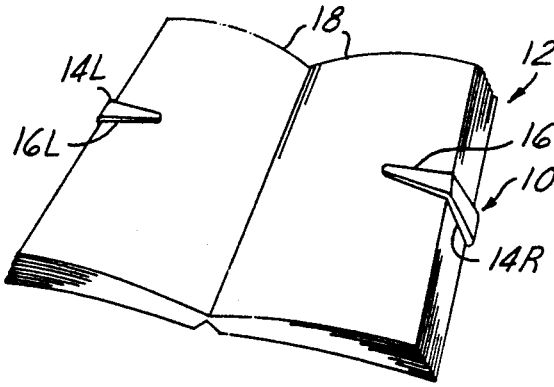
FIG. 1
FIG. 2
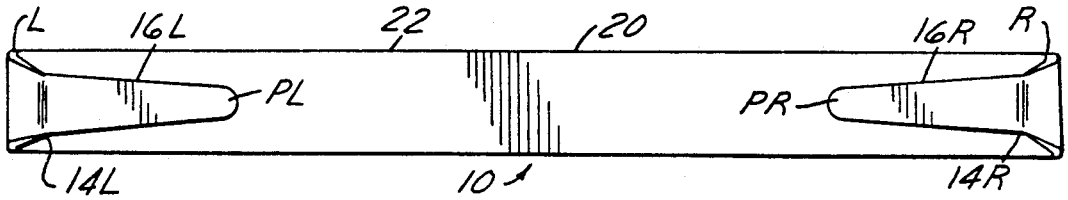
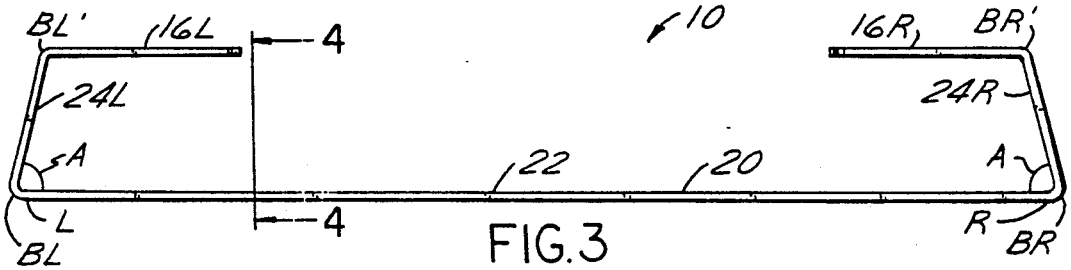
FIG. 3
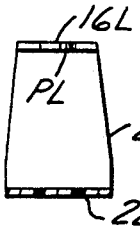
FIG. 4
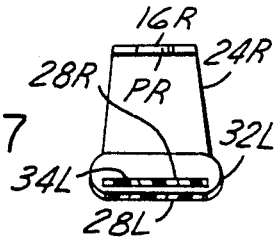
FIG. 7
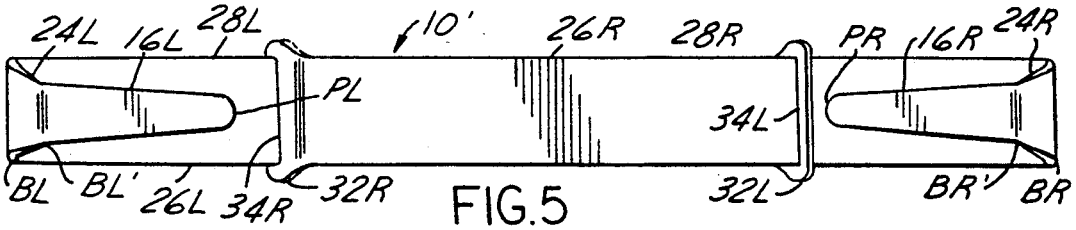
FIG. 5
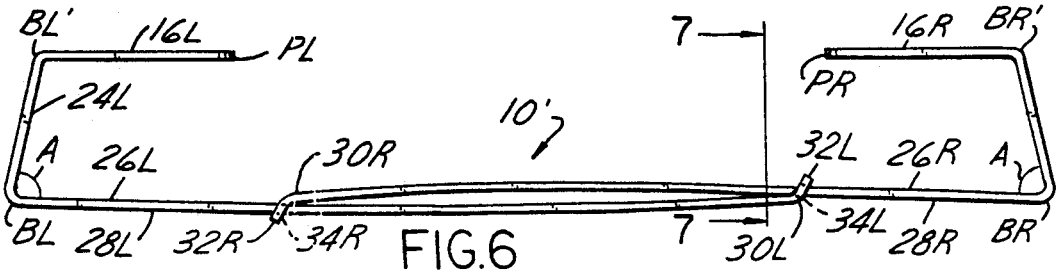
FIG. 6

BOOK HOLDER

CROSS-REFERENCE TO RELATED APPLICATIONS

The present application is a continuation-in-part application of presently co-pending parent application Ser. No. 07/720,257, filed on Jun. 24, 1991, now U.S. Pat. No. 5,165,723, issued on Nov. 24, 1992.

BACKGROUND OF THE INVENTION

1. Field of the Invention

The present invention relates to book holders for holding open a book so as to facilitate reading of the pages of the book. Still more particularly, the present invention relates to a book holder which is of a simple, light and easy to use construction.

2. Description of the Prior Art

The process of reading a book can become somewhat tedious, in that the reader must constantly hold open the book against the resilient action of its spine. More importantly, those readers who are physically handicapped must struggle all the more with keeping the book open in a configuration that favors page reading.

In the prior art there have been various kinds of book holders, as exemplified by the following U.S. patents. U.S. Pat. No. 1,196,715 to Noll, dated Aug. 29, 1916, discloses a book holder which holds open the pages at the spine of the book via operation of a rear bracket and two spreadable legs. U.S. Pat. No. 1,710,949 to Pokora, dated Apr. 30, 1929, discloses a book holder in which a clip portion is spring loaded with respect to a finger, the finger holding the pages of the book open. U.S. Pat. No. 4,382,617 to Fortier, dated May 10, 1983, discloses a book holder having a central set of prongs which engage the book at the spine, and a set of arms connected thereto for holding the pages open. U.S. Pat. No. 4,474,383 to Kikis, dated Oct. 2, 1984, discloses a book holder having a base with two opposing looped end portions, wherein a book sits atop the base and the pages are held open by capture within the looped end portions. U.S. Pat. No. 4,512,542 to Black, dated Apr. 23, 1985, discloses a book holder in the form of two mutually pivotably connected wires, each wire having a looped end portion; legs are hingably connected thereto, as well. U.S. Pat. No. 4,645,236 to Kemp, Jr., dated Feb. 24, 1987, discloses a book holder in the form of a flat member having a slotted flat finger at each end for engaging pages of the book. Finally, U.S. Pat. No. 4,932,680 to Rivera, dated Jun. 12, 1990, discloses a book holder in the form of a wire shaped to include a leg portion that inserts into the spine of the book, and a front transverse portion connected to the leg portion which effects to hold pages of the book in place.

While each of the foregoing patents discloses a book holder which serves to hold pages of a book in an open, readable configuration, each suffers from one or more of the following: excessive complexity, weight, or cost; difficulty to use (too much work to adjust each time a page is turned); and potential damage to the book (wherever a spine engagement is required). Accordingly, what remains needed in the art is a book holder which holds a book open so that the pages may be easily read, is light, inexpensive, and very easily accommodates page turning.

A book holder addressing the aforesaid need in the art is the above identified parent application, wherein a book holder of a simply connected wire construction is disclosed. More specifically, two wire elements are provided, each having a base portion. The base portions are mutually separated a relatively small predetermined distance. At either side of the base portion of each wire element, the wire elements conjoin so as to form U-shaped ends. The U-shaped ends are dimensioned so as to provide an overhang for trapping the pages of a book between the overhang and the respective adjacent base portions.

In operation, the user engages an open book with the book holder so that a portion of opposing sides of the book (that is, the left and right side of the book located at opposite sides of its spine) are captured by the U-shaped ends and the two wire elements. The U-shaped ends are dimensioned so that they do not pose a problem with comfortable reading of the pages. When it is time to turn pages, a simple finger movement is all that is necessary to remove the page being turned from the overhang on the right and to trap it under the overhang on the left (and vice versa).

While the book holder described in the above identified parent application is very practical and is shaped to solve all the problems in prior art book holders, it still suffers from the structural limitation of being constructed of metallic wire or otherwise wire-like shaped material. What is needed, therefore, is a book holder shaped like that disclosed in parent application Ser. No. 07/720,257 and yet is made of an elongate panel, and which, optionally, is also selectively extensible so as to accommodate a range of book widths.

SUMMARY OF THE INVENTION

The book holder according to the present invention is composed of a simply constructed elongate panel. The elongate panel is constructed of a light, durable material, such as plastic and includes a base portion and a U-shaped end at each of the opposite ends thereof. The U-shaped ends are dimensioned so as to provide an overhang for trapping the pages of a book between the overhang and the respective adjacent base portion.

In operation, the user engages an open book with the book holder so that a portion of opposing sides of the book (that is, the left and right side of the book located at opposite sides of its spine) are captured by the U-shaped ends and the base portion. The U-shaped ends are dimensioned so that they do not pose a problem with comfortable reading of the pages; indeed the plastic may be clear or otherwise see-through. When it is time to turn pages, a simple finger movement is all that is necessary to remove the page being turned from the overhang on the right and to trap it under the overhang on the left (and vice versa).

In a variation of the foregoing, an extensible book holder is disclosed having a right base component and a left base component which are joined so as to permit a selectively extensible interaction therebetween for accommodating books of various widths with a single book holder.

Accordingly, it is an object of the present invention to provide a book holder which is of simple construction, is inexpensive, and light-weight.

It is another object of the present invention to provide a book holder which easily accommodates and facilitates page turning.

It is a further object of the present invention to provide an easily manufactured book holder.

It is yet another object of the present invention to provide a book holder which is selectively extensible so as to accommodate books of various width.

It is still another object of the present invention to provide a book holder in which paralyzed persons and persons with arthritis or other disabilities can easily turn book pages using the book holder, needing only a pencil-like tool held in their mouth.

These, and additional objects, advantages, features and benefits of the present invention will become apparent from the following specification.

BRIEF DESCRIPTION OF THE DRAWINGS

FIG. 1 is a perspective view of the book holder according to the present invention, shown in operation.

FIG. 2 is a top plan view of the book holder as shown in FIG. 1.

FIG. 3 is a side view of the book holder as shown in FIG. 1.

FIG. 4 is a partly sectional end view of the book holder, seen along lines 4—4 in FIG. 3.

FIG. 5 is a top plan view of a first version of an extensible book holder according to the present invention.

FIG. 6 is a side view of the extensible book holder as shown in FIG. 5.

FIG. 7 is a partly sectional end view of the extensible book holder, seen along lines 7—7 in FIG. 6.

DETAILED DESCRIPTION OF THE PREFERRED EMBODIMENT

Figure 8:
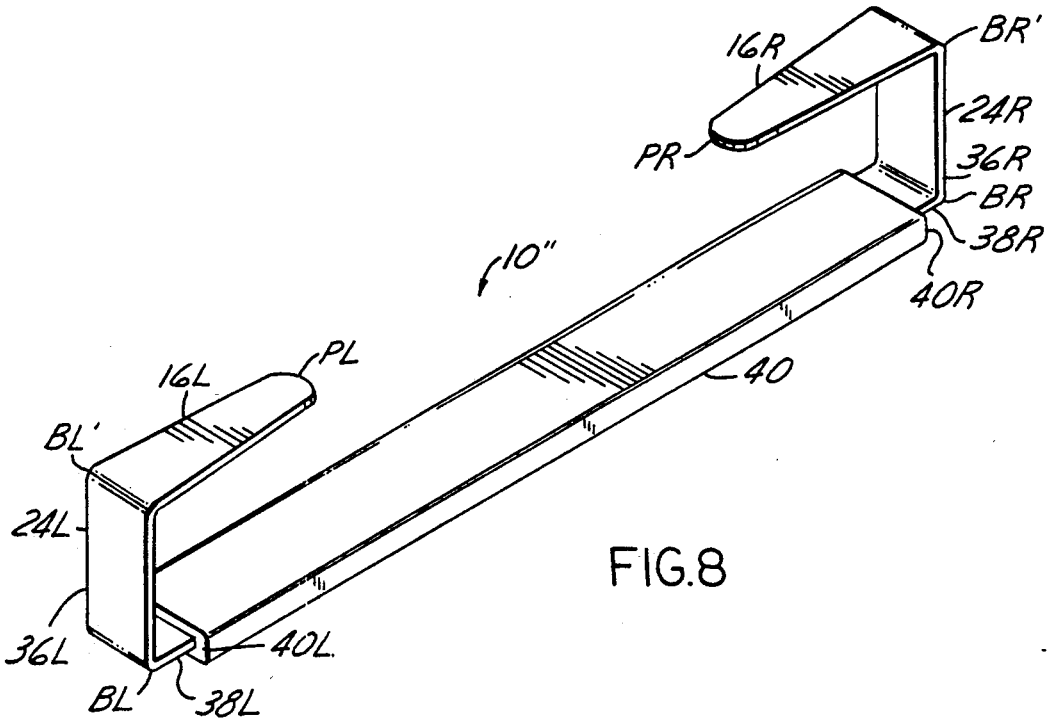
FIG. 8 is a perspective view of a second version of an extensible book holder according to the present invention.

Referring now to the Drawing, FIG. 1 shows the book holder 10 according to the present invention in operation in connection with a book 12. As can be discerned from FIG. 1, the book holder 10 includes two generally U-shaped ends 14L and 14R. These U-shaped ends each include a V-shaped overhang 16L and 16R which is dimensioned to engage the pages 18 of the book 12 so as to hold the book in an open, readable configuration.

The structure of the book holder 10 will now be defined, with reference being particularly made to FIGS. 2 through 4.

The book holder 10 is preferred to be constructed of an elongate panel 20, the composition of which is preferred to be plastic which is, still more preferably, either clear or selected see-through colors or non-see through colors; although other compositions, such as aluminum or fiberglass, are possible. Further, it is contemplated that advertising messages or other indicia may be imprinted upon the elongate panel.

The elongate panel 20 has a base portion 22. The base portion 22 is preferably of thin thickness (for example on the order of a sixteenth inch) and of narrow width (for example on the order of from one-quarter to one inch), the exact dimensions being selected according to design choice. The base portion 22 terminates at a left location L and right location R. Upright portions 24L, and 24R are integrally connected with the base portion 22 at respective left and right locations L, R, as shown particularly in FIG. 3. It is preferred for each of the upright portions 24L, 24R to be formed by a respective bend BL, BR in the elongate panel 20, and that the upright portions be oriented at an angle A of generally 70 to 90 degrees with respect to the base portion 22. The overhangs 16L, 16R are integrally connected to respective upright portions 24L, 24R by bending of the elongate panel 20 at respective bends BL' and BR'. As shown in FIG. 3, the overhangs 16L, 16R each terminate in a blunt V-shape PL, PR. It is preferred for the overhangs to lie in a plane which is oriented generally parallel with respect to the plane in which lies the base portion 22. The combination of the overhangs, the upright portions and that part of the base portions which are generally coextensive with the overhangs collectively form the U-shaped ends 14L, 14R, there being a U-shaped end at each side L, R of the base portion 22.

As an example of a book holder 10, it is preferred to use a clear high impact resistant plastic formed by injection molding. The base portion has a length of about 9 inches, a width of about three-quarters of an inch, and a thickness of about one-sixteenth of an inch; the upright portions each have a length of about one and one-half inch; and, finally, the overhangs each have a length on the order of one and one-half inch.

It is to be understood that the underlying reason for selecting a base portion width is in order to provide a stable connection of the hook holder 10 with respect to the book 12 so that operation is facilitated, as made described hereinbelow. Further, it is to be understood that the overhang points PR, PL provide an optimum shape which facilitates ease of page turning, as described hereinbelow.

In operation, the user positions an open faced book so that the left edge of the book (on that side of the book left of its spine) is located within the left side U-shaped end, thereby capturing the pages on the left side of the book therein. The user then manipulates the book so that the right edge of the book (on that side of the book right of its spine) is located within the right side U-shaped end, thereby capturing the pages on the right side of the book therein. It is preferred for the book holder 10 to be located about midway between the top and bottom of the book 12, as shown in FIG. 1, but the user may choose to move the book holder up and down the book as desired, and the points PL, PR may be used as last-line-read book marks when reading is temporarily stopped. The right side page may be removed from capture by the overhang at the right side U-shaped end by a simple finger sliding manipulation of the page. The page may then be inserted under the overhang at the left side U-shaped end by finger sliding manipulation of the page thereunder.

Turning now to FIGS. 5 through 10 an extensible book holder of the type referred to hereinabove and shaped as that disclosed in the above identified parent application, will now be detailed.

A first version of extensible book holder 10' is depicted in FIGS. 5 through 7. In this regard, parts remain identified as hereinabove described, except that now the elongate panel is constructed of two panel components, a left panel component 26L and a right panel component 26R. Each of the two panel components 26L, 26R has a base portion 28L, 28R which is sufficiently long so as to provide mutual overlap thereof over a range of permissible extension adjustments, as will become clear momentarily.

The distal end 30L, 30R, respectively, of each base portion 28L, 28R is provided with an upturned flange 32L, 32R which has a slot 34L, 34R therein. The slots 34L, 34R of each base portion is dimensioned to receive the other base portion. Consequently, the base portions 28L, 28R are mutually slidable in respective slots 34L, 34R so that the book holder 10' may be extended to a maximum length defined by the two upturned flanges 32L, 32R mutually abutting, and collapsed to a minimum length defined by the two upturned flanges abutting, respectively, bends BL, BR.

Figure 9:
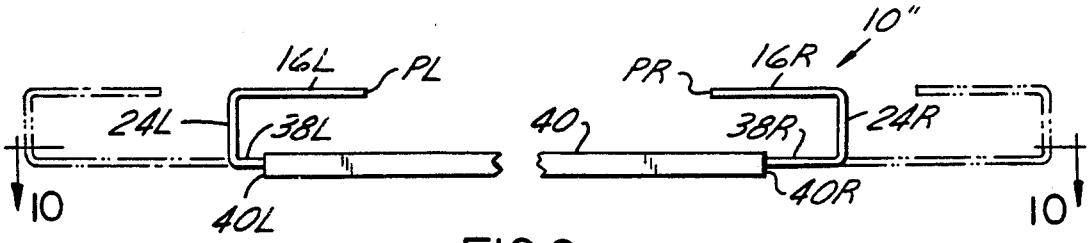
FIG. 9 is a side view of the extensible book holder as shown in FIG. 8.
Figure 10:
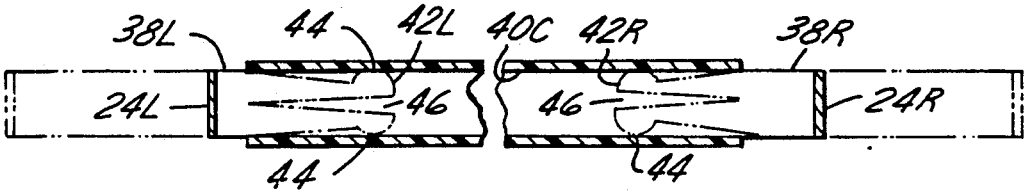
FIG. 10 is a partly sectional plan view seen along lines 10—10 in FIG. 9.

A second version of extensible book holder 10" is depicted in FIGS. 8 through 10. In this regard as in the first version of the extensible book holder 10', parts remain identified as hereinabove described, except that now the elongate panel is constructed of two panel components, a left panel component 36L and a right panel component 36R. Each of the two panel components 36L, 36R has a base portion 38L, 38R. A base sleeve 40 is provided having opposite ends 40L, 40R.

The distal end 42L, 42R, respectively, of each base portion 38L, 38R is bifurcated with a nib 44 on either side of a slit 46. The nibs of each distal end mutually provide a width exceeding that of the base portions 38L, 38R, but not by more than the cross-section of the slit 46, as shown in FIG. 10. The ends 40L, 40R respectively receive a distal end 42L, 42R of the base portions 38L, 38R. At each distal end 42L, 42R, the nibs 44 resiliently force the slit 46 to narrow sufficiently to allow the distal end to insert into the respective end of the base sleeve, the base sleeve having interior walls 40C dimensioned to snugly accommodate the base portions 38L, 38R. The resulting resilient force of the nibs on the base sleeve provides a frictional force which holds the extensible book holder 10" at any selected length. As shown in FIG. 9, possible selected lengths are defined by a maximum length in which the distal ends remain just within the base sleeve to a minimum length in which the distal ends mutually abut within the base sleeve. If desired, bosses can be provided adjacent the ends of the base sleeve to prevent the distal ends of the base portions from accidentally exiting the base sleeve.

From the foregoing examples of extensible book holders, it will be apparent to artisans that other extensible enabling mechanisms for the book holder are possible, and these are acknowledged as being within the scope of the invention.

To those skilled in the art to which this invention appertains, the above described preferred embodiments are presented by way of preferred example and may, therefore, be subject to change or modification. Such change or modification can be carried out without departing from the scope of the invention, which is intended to be limited only by the scope of the appended claims.

What is claimed is:

1. An extensible book holder for holding open a book so that the pages thereof may be selectively read by a reader, said book holder being extensible in order to accommodate various books of differing size, said extensible book holder comprising:

a left elongate panel comprising:

a left base portion, said left base portion having a length defined by a left end location and a right distal end;

a left upright portion having a second length defined by a first end and a second end thereof, said first end of said left upright portion being connected with said left end location of said left base portion, said left upright portion being oriented relative to said left base portion at a first predetermined angle with respect thereto; and a left overhang having a third length defined by a first end and a second end thereof, said first end of said left overhang being connected with said second end of said left upright portion, said left overhang being oriented at a predetermined orientation with respect to said left upright portion;

a right elongate panel comprising:

a right base portion, said right base portion having a fourth length defined by a right end location and a left distal end;

a right upright portion having substantially said second length defined by a first end and a second end thereof, said first end of said right upright portion being connected with said right end location of said right base portion, said right upright portion being oriented relative to said right base portion at a second predetermined angle with respect thereto; and a right overhang having substantially said third length defined by a first end and a second end thereof, said first end of said right overhang being connected with said second end of said right upright portion, said right overhang being oriented at a predetermined orientation with respect to said right upright portion;

wherein said right upright portion, said right overhang and said right base portion collectively form a right U-shaped end of said right elongate panel, and wherein said left upright portion, said left overhang and said left base portion collectively form a left U-shaped end of said left elongate panel; and extensible means connected with said left and right distal ends for keeping said left base portion aligned with said right base portion while providing selective extensibility between said left U-shaped end and said right U-shaped end; wherein said extensible means comprises:

a base sleeve having a right end and a left end;

left distal end means on said right base portion for resiliently deforming when inserted into said right end of said base sleeve so as to provide a frictional interaction with said base sleeve as said right base portion is slid in said base sleeve; and right distal end means on said left base portion for resiliently deforming when inserted into said left end of said base sleeve so as to provide a frictional interaction with said base sleeve as said left base portion is slid in said base sleeve;

wherein said right and left base portions are mutually slidable in said base sleeve so that said right and left U-shaped ends are extendable to a maximum separation therebetween defined by said right and left distal end being located adjacent said right and left ends of said base sleeve, and to a minimal separation therebetween defined by said right and left distal ends mutually abutting;

wherein said extensible means allows said left and right U-shaped ends to be mutually moved so that a left end portion of the book is placed between said left overhang and said left base portion and a right end portion of the book is placed between said right overhang and said right base portion to thereby selectively hold open the book.

2. The extensible book holder of claim 1, wherein said right distal end means comprises said right distal end having a pair of nibs mutually separated by a right slit, and wherein said left distal end means comprises said left distal end having a pair of left nibs mutually separated by a left slit; wherein each of said right and left base portions have a predetermined width, and each said pair of nibs have a second width exceeding said predetermined width.

3. The book holder of claim 2, wherein said first and second predetermined angles are substantially between 70 and 90 degrees.

4. The book holder of claim 3, wherein said predetermined orientation of each of said right and left overhangs is such that each of said right and left overhangs lie in a plane that is substantially parallel with a plane in which said base portion lies; and wherein said left end overhang and said right end overhang are each formed of a substantially V-shape terminating in a substantially blunt point, each substantially blunt point being oriented so as to mutually face toward one another.

5. The book holder of claim 4, wherein said right and left base portions are constructed of plastic.

6. The book holder of claim 5, wherein said plastic is selected from a see-through plastic material.

* * * * *